United States Patent [19]

Sherwood et al.

[11] Patent Number: 4,635,756

[45] Date of Patent: Jan. 13, 1987

[54] ELEVATOR CAB

[75] Inventors: Edward F. Sherwood, Gettysburg; Paul L. Baldwin, Franklin Township, Adams County; Karl B. Orndorff, Bonneauville Boro, all of Pa.; Charles M. Dillon, Emmitsburg, Md.

[73] Assignee: Westinghouse Electric Corp., Pittsburgh, Pa.

[21] Appl. No.: 753,282

[22] Filed: Jul. 9, 1985

[51] Int. Cl.[4] ..... B66B 9/00

[52] U.S. Cl. ..... 187/1 R; 52/282; 52/397; 98/40.1

[58] Field of Search ..... 187/1 R; 52/397, 400, 52/282, 512, 212, 204, 211, 585; 98/40.1, 31, 42.1, 42.07

[56] References Cited

U.S. PATENT DOCUMENTS

| | | | |
|---|---|---|---|
| 3,631,942 | 1/1972 | Brounn | 187/1 R |
| 3,652,380 | 3/1972 | Strack | 52/397 |
| 4,240,235 | 12/1980 | Nawa | 52/397 |
| 4,366,748 | 1/1983 | Wilson et al. | 98/40.1 |
| 4,394,809 | 7/1983 | Sherwood et al. | 52/512 |
| 4,430,835 | 2/1984 | Ericson | 52/282 |
| 4,462,193 | 7/1984 | Ericson | 52/282 |
| 4,549,472 | 10/1985 | Endo et al. | 98/40.1 |

FOREIGN PATENT DOCUMENTS

| | | | |
|---|---|---|---|
| 648472 | 3/1964 | Belgium | 187/1 R |
| 1174425 | 11/1982 | Canada . | |
| 2523064 | 10/1976 | Fed. Rep. of Germany | 187/1 R |

*Primary Examiner*—Joseph J. Rolla
*Assistant Examiner*—Kenneth Noland
*Attorney, Agent, or Firm*—D. R. Lackey

[57] ABSTRACT

A lightweight elevator cab constructed essentially of aluminum, including upstanding side, rear and front wall portions. Perimetrically flanged, rectangularly shaped aluminum wall panel members have their adjacent flanged edges joined together to form a side wall portion, and in most cases the rear wall portion as well. The rear wall may also be constructed essentially of glass panels, if desired. The lower flanges of the aluminum wall panels are attached to a support platform, and the upper flanges support a canopy formed of aluminum honeycomb sandwiched between two flat aluminum sheet members. The cab front includes a stationary aluminum portion which forms a wiring duct, and an aluminum swing return panel punched to receive car fixtures. The car door includes front and back perimetrically flanged aluminum pan members telescoped snugly together with a reinforcing rib of one pan in contact with the opposing pan member.

8 Claims, 30 Drawing Figures

FIG. 13
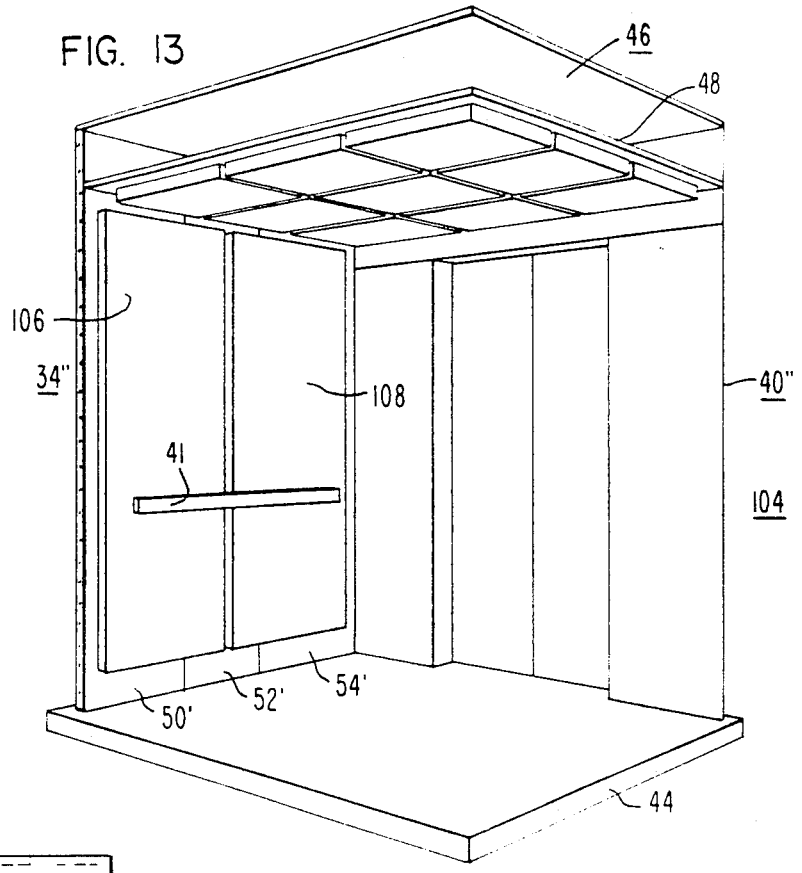
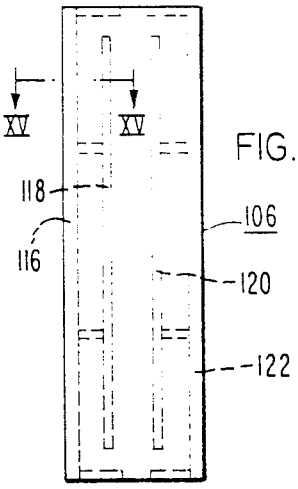
FIG. 14
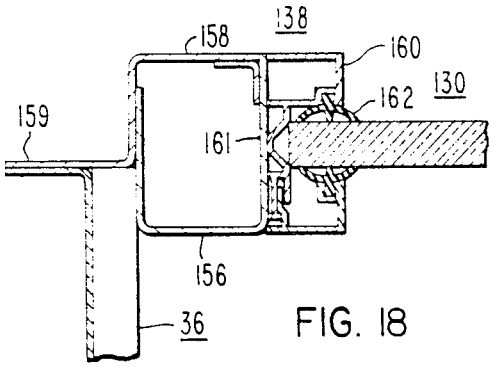
FIG. 18
FIG. 15
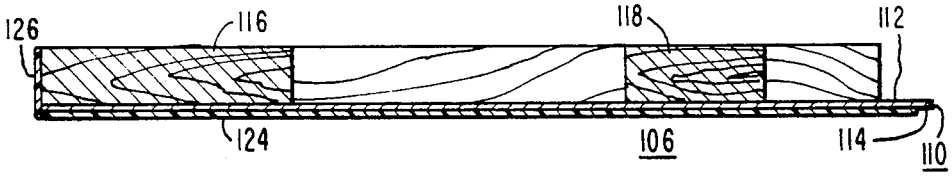

ELEVATOR CAB

BACKGROUND OF THE INVENTION

1. Field of the Invention

The invention relates to elevator cab construction.

2. Description of the Prior Art

Elevator cabs are mounted on a platform. In a traction elevator system, the platform is supported by a sling, with the wire hoist ropes being connected to the sling. In a hydraulic elevator system, the platform is supported by the plunger of a hydraulic jack. In either system, considerable savings may be realized by reducing the weight of the cab. For example, the spacing between guide rail brackets and rail clips may be increased, smaller and lower rated drive units may be used, and shipping costs are reduced. In a traction elevator system, the size and cost of the safety may be reduced, the number and/or diameter of the wire hoist ropes may be reduced, the weight of the counterweight may be reduced, and the weight of the compensation may be reduced. An exemplary prior art approach to cab weight reduction utilizes a thin skeleton of interconnected steel members, which are rigidized by panels constructed of expanded core plastic material.

It would be desirable to construct a lightweight elevator cab having the requisite strength and rigidity, without requiring the construction of a skeleton, and without increasing the size of the hatch in order to obtain the required net floor area in the cab.

SUMMARY OF THE INVENTION

Briefly, the present invention is a new and improved lightweight elevator cab which is constructed essentially of aluminum, resulting in a savings of about 600 pounds per cab, compared with a steel cab. In addition to the significant savings in weight, which provides the advantages hereinbefore set forth, it has been found that aluminum construction deadens sound and reduces squeaks, compared with a steel cab. Also, paint need only be applied for decorative purposes. It is not required for corrosion or rust prevention, adding to the savings in manufacturing costs.

More specifically, the elevator cab includes upstanding side, rear and front wall portions, with at least the side wall portions being formed of rectangularly shaped aluminum wall panel members, which are permetrically flanged. The side or lateral flanges of adjacent wall panel members are joined together, the lower flanges are attached to the supporting platform, and a canopy is attached to the upper flanges. The rear wall may be of similar construction, but with the disclosed elevator cab arrangement, it may also be constructed of glass, when required for observation purposes. Except for steel angles for supporting a door operator, the front of the cab is also constructed of aluminum. The cab front includes a stationary portion which defines a wiring duct, and an aluminum swing return panel punched for pushbuttons, car position indicators, direction arrows, and the like. The canopy is constructed of aluminum honeycomb sandwiched between and adhesively bonded to two flat aluminum sheet members.

A door, comprising one or more door panels, which opens and closes the entrance at the front of the cab, is constructed of aluminum. Each door panel includes front and rear perimetrically flanged, aluminum pan members, with each pan member having a reinforcing rib. The front and rear members are telescoped together, with the rib of one pan contacting a flat major surface of the opposing pan.

BRIEF DESCRIPTION OF THE DRAWING

The invention may be better understood, and further advantages and uses thereof more readily apparent, when considered in view of the following detailed description of exemplary embodiments, taken with the accompanying drawings, in which:

FIG. 13 is a perspective view of an elevator cab, illustrating how decorative panel members may be hung on the interior side walls of the cab shown in FIG. 1;

FIG. 14 is an elevational view of one of the decorative panels shown in FIG. 13;

FIG. 15 is a cross-sectional view of the decorative panel shown in FIG. 14, taken between and in the direction of arrows XV—XV;

FIG. 18 is a cross-sectional view of a rear wall portion shown in FIG. 16, taken between and in the direction of arrows XVIII—XVIII;

DESCRIPTION OF PREFERRED EMBODIMENTS

Figure 1:
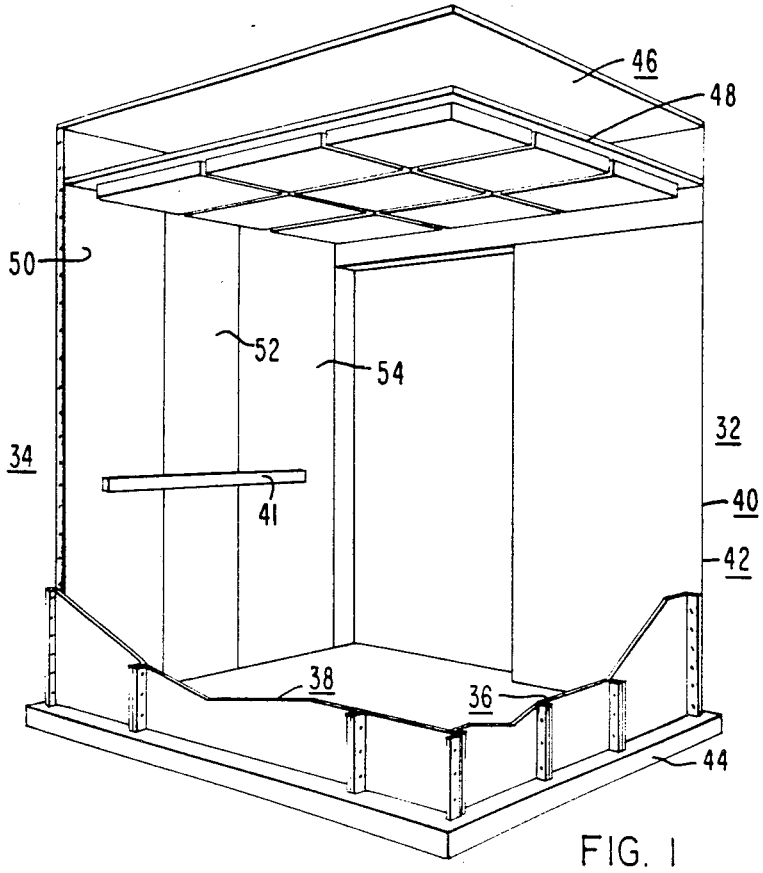
FIG. 1 is a perspective view of an elevator car constructed according to a first embodiment of the invention, with the rear and one side wall portion being partially cut away, as they may be constructed the same as the fully illustrated side wall portion.
Figure 2:
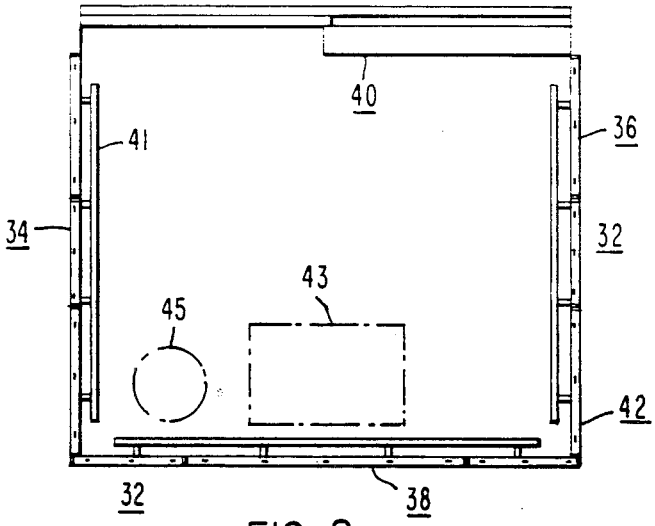
FIG. 2 is a plan view of the elevator cab shown in FIG. 1, with the canopy and drop ceiling not shown.
Figure 4:
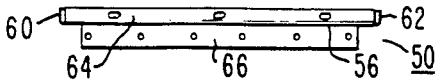
FIG. 4 is a plan view of the aluminum wall panel member shown in FIG. 3.
Figure 10:
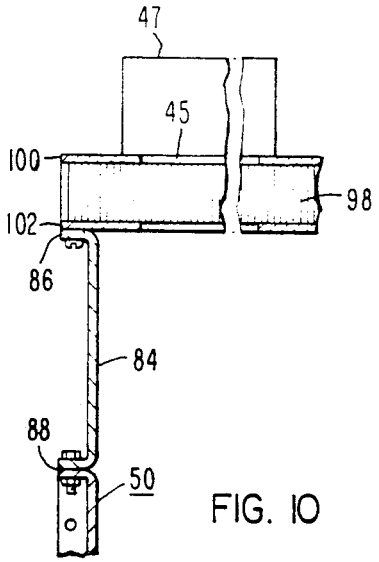
FIG. 10 is a cross-sectional view of the cab shown in FIG. 9, taken between and in the direction of arrows X—X.

Referring now to the drawings, and to FIGS. 1 and 2 in particular, there is shown a lightweight elevator cab 32 constructed according to the teachings of the invention. FIG. 2 is a plan view of elevator cab 32, with parts cut away. Cab 32 includes upstanding side wall portions 34 and 36, and upstanding rear and front portions 38 and 40, respectively, all of which are assembled to define an enclosure 42 having inner and outer surfaces and upper and lower edges. Suitable handrails may be attached to the side and rear wall portions, such as handrail 41 on side wall 34. Enclosure 42 is supported by a platform 44, with the lower edge of the enclosure being fixed to the platform. Platform 44 may be supported by the plunger of a hydraulic cylinder, if cab 32 is associated with a hydraulic elevator system, or it may be supported by a sling, if it is associated with a traction elevator system. A canopy 46 is attached to the upper edges of enclosure 42. Cab lighting fixtures may be attached to the canopy, and a drop ceiling 48 may be suspended from canopy 46 to conceal the light source and to diffuse the light. Canopy 46 also includes an emergency exit 43 and an opening 45 over which a ventilating fan 47 may be mounted, with the emergency exit 43 and opening 45 being shown in phantom in FIG. 2. Opening 45 and fan 47 are shown in FIG. 10.

Each of the side wall portions 34 and 36 are of like construction, with each side wall portion being constructed of a plurality of aluminum wall panel members, such as aluminum wall panel members 50, 52 and 54. The wall panel members are of like construction, and they may be made up in standard and non-standard widths, as will be hereinafter explained. Wall panel member 50, for example, is shown in FIGS. 3, 4, 5 and 6, with FIG. 3 being a front elevational view, FIG. 4 a plan view, FIG. 5 an end view, and FIG. 6 a cross-sectional view taken between and in the direction of arrows VI—VI in FIG. 3.

Figure 3:
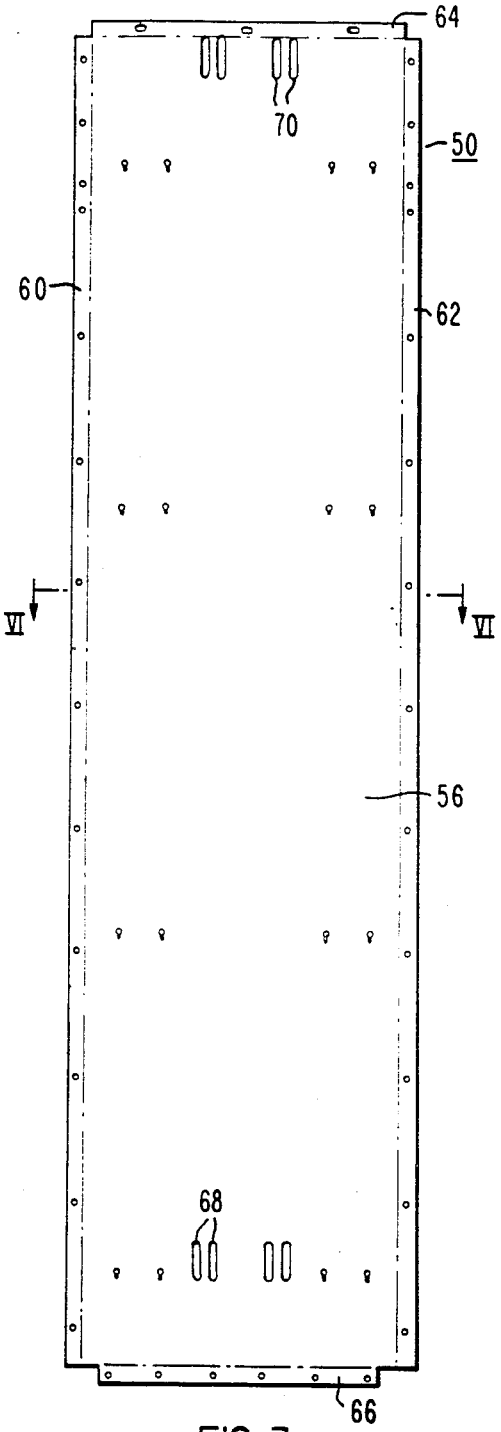
FIG. 3 is an elevational view of an aluminum wall panel member used to construct wall portions of the elevator cab shown in FIGS. 1 and 2.
Figure 5:
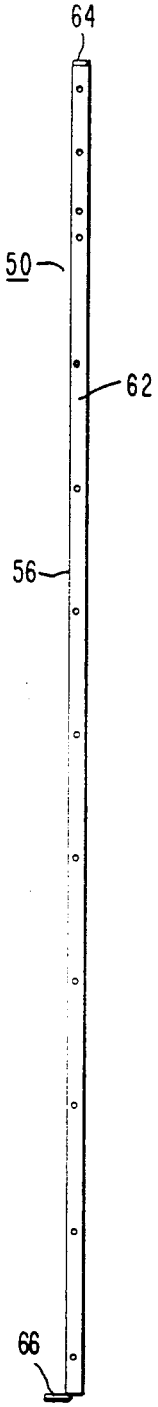
FIG. 5 is a side-elevational view of the aluminum wall panel member shown in FIG. 3.
Figure 6:
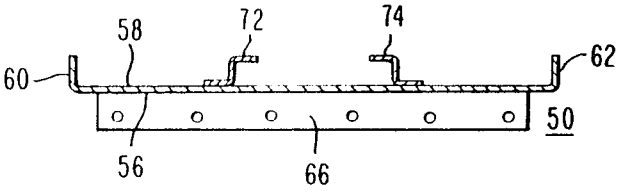
FIG. 6 is a cross-sectional view of the aluminum wall panel member shown in FIG. 3, taken between and in the direction of arrows VI—VI.

FIG. 3 shows wall panel member 50 in the form of a flat sheet of aluminum, having an elongated, rectangular configuration. For example, the sheet of aluminum may have a thickness dimension of 0.063 inch. The flat aluminum sheet has major flat opposed surfaces 56 and 58, with surface 56 being an inner surface of the enclosure 42, and surface 58 being part of the outer surface. Bend lines about the perimeter of the aluminum sheet are shown in phantom, which form perimetrical flanges on all four edges of the rectangular configuration. When viewing wall panel member 50 in its upstanding operative position, it includes first and second lateral flanges 60 and 62, respectively, an upper flange 64, and a lower flange 66. The lateral flanges 60 and 62 and upper flange 64 extend perpendicularly outward from the external surface 58, and the bottom flange 66 extends perpendicularly outward from the interior surface 56. The perimetrical flanges have suitable openings therein for receiving fasteners. Ventilating openings 68 are spaced a predetermined dimension from the lower flanged end 66, and ventilating openings 70 are disposed immediately adjacent to the upper flanged edge 64 of the panel member.

In order to stiffen the aluminum wall panel member 50, one or more rib members, with the number depending upon the panel width between the lateral flanges 60 and 62, are welded to the exterior surface 58. For example, wall panel member 50 may have first and second rib members 72 and 74 welded to surface 58. Each rib member 72 and 74 may be formed from an aluminum strip having the same thickness dimension as the wall panel member 50. The aluminum strip is bent into a suitable configuration, such as the Z-shaped configuration shown in FIG. 6.

Figure 7:
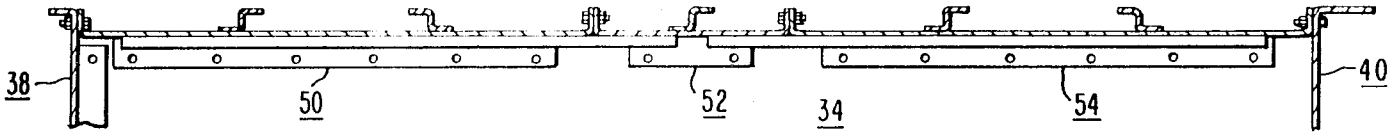
FIG. 7 is a plan view of a side wall portion of the cab shown in FIG. 1 illustrating how the aluminum panel members are joined to form a wall portion.
Figure 8:
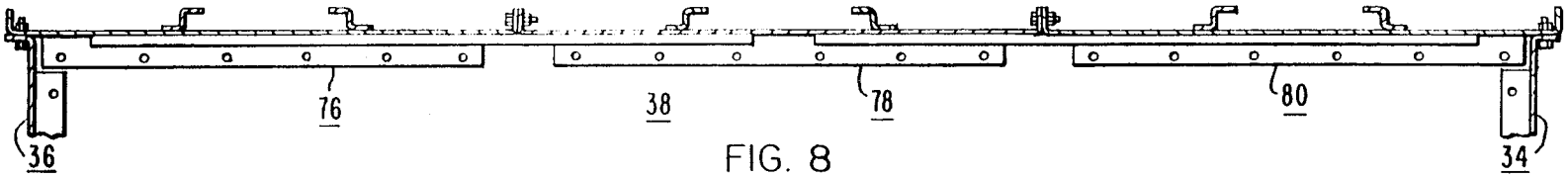
FIG. 8 is a plan view of a rear wall portion of the cab shown in FIG. 1 constructed of aluminum wall panel members.

FIGS. 7 and 8 are cross-sectional views of the side and rear wall portions 34 and 38, respectively, illustrating how the aluminum wall panel members are joined together at their lateral flanges. FIGS. 7 and 8 also illustrate how standard width aluminum wall panel members may be used in each wall portion. For example, wall panel members 50 and 54 in side wall portion 34 may be a standard width panel and made for stock. Wall panel member 52 may be a non-standard panel whose width dimension is selected to complete the required overall width dimension of the associated side wall portion. In like manner, rear wall portion 38 may have three wall panel members 76, 78 and 80. The central wall panel 78, for example, may be a standard width panel, i.e., a panel having the same width dimension as wall panel members 50 and 54 of the side wall portion 34, and the remaining panel members 76 and 80 may be non-standard width panels selected to provide the desired overall width of the rear wall portion 38.

Figure 9:
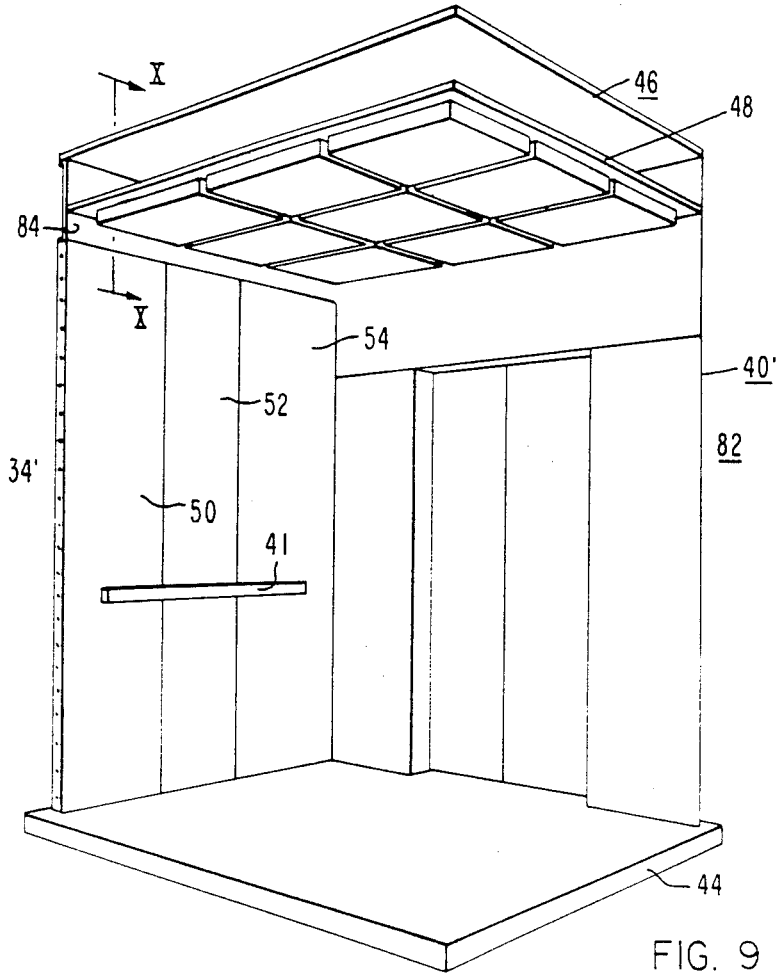
FIG. 9 is a perspective view of an elevator cab, illustrating how the cab height of the FIG. 1 cab may be extended, utilizing the same aluminum wall panel members of the standard height cab shown in FIG. 1.

The wall panel members, such as wall panel member 80, are all constructed to a standard eight foot cab height dimension. The height dimension of these wall panel members never changes, even when higher cab floor-to-ceiling heights are required. The additional height is provided by a single horizontally oriented panel member per flanged edges of the plurality of wall panel members. FIG. 9 is a perspective view of an elevator cab 82 constructed according to this embodiment of the invention, with side wall portion 34' being similar to side wall portion 34 of cab 32 shown in FIG. 1, except for the addition of a horizontally oriented aluminum panel member 84. Cab 82 also shows a front 40' having a center opening, instead of the side opening in the front 40 of cab 32, in order to illustrate that the invention applies to either construction. FIG. 10 is a cross-sectional view through panel member 84, taken between and in the direction of arrows X—X in FIG. 9.

As best shown in FIG. 10, panel member 84 may be formed of a sheet of aluminum having the same thickness as the aluminum wall panel members. The sheet of aluminum has an elongated, rectangular configuration, with its elongated edges being bent in a common direction to provide upper and lower flanges 86 and 88, respectively, when viewed in its installed orientation. The lower flange 88 is attched to the flanges along the upper edges of the upstanding wall panel members 50, 52 and 54, and its upper flange is fixed to canopy 46. This construction provides a horizontal rib, which cooperates with the vertical ribs in strengthening the wall portion.

Figure 11:
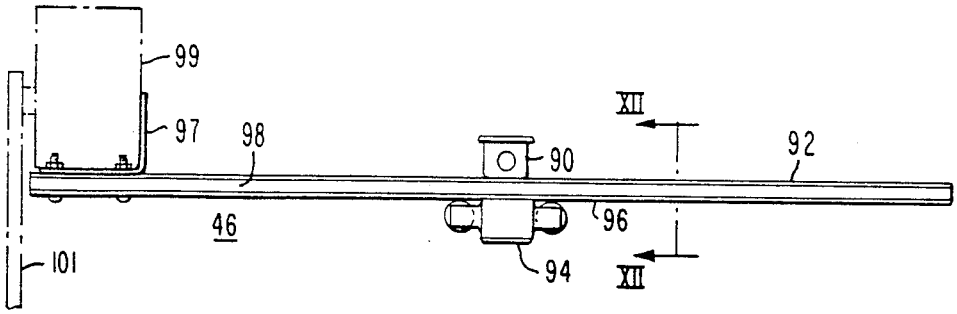
FIG. 11 is an end-elevational view of the canopy shown in FIG. 1.
Figure 12:
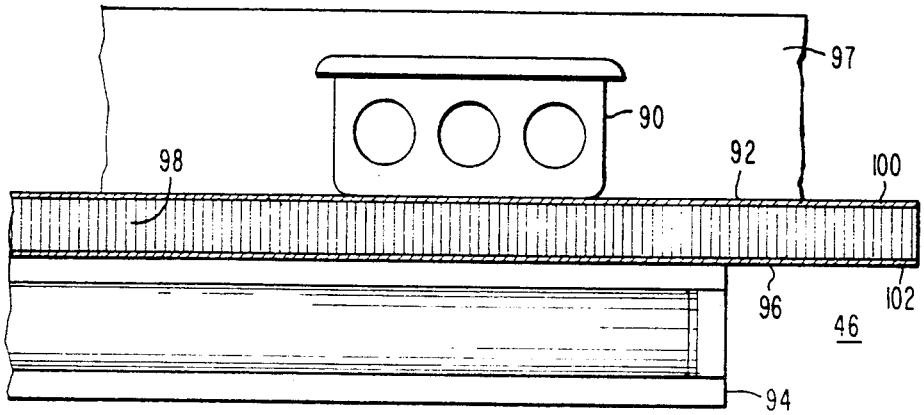
FIG. 12 is a cross-sectional view of the canopy shown in FIG. 11, taken between and in the direction of arrows XIII—XIII.

FIG. 11 is an elevational view of canopy 46, and FIG. 12 is an enlarged cross-sectional view through the canopy 46, taken between and in the direction of arrows XII—XII. Canopy 46, in addition to the opening 45 for cooperating with ventilating fan 47, and an emergency exit 43, includes an electrical junction box 90 on its upper surface 92, and a light source, such as one or more fluorescent lighting fixtures 94, on its lower surface 96. A bracket 97, only partially shown in FIG. 11, may be used to secure a door operator 99 to the canopy 46. As shown most clearly in the enlarged cross-sectional viewof FIG. 12, canopy 46 is formed of aluminum honeycomb 98 sandwiched between upper and lower flat aluminum sheet members 100 and 102, respectively. The sheet members may be the same thickness as the aluminum panel members. The aluminum honeycomb 98 has a large plurality of cells, which define openings which extend between the aluminum sheet members 100 and 102. In other words, the terminating edges of the cells lie in first and second flat parallel planes, and these terminating edges are fixed to sheet members 100 and 102, such as by an adhesive bond.

As shown in FIG. 10, sheet members 100 and 102 may have vertically aligned openings therein to form the opening 45, above which the ventilating fan 47 may be mounted. The aluminum honeycomb 98 between the aligned openings is not removed, but remains to function as a grille for the fan.

In most instances, the aluminum wall panel members will be substantially covered by a plurality of decorative panel members, removably attached to the upstanding side wall and rear wall portions 34, 36 and 38. FIG. 13 is a perspective view of an elevator cab 104 constructed according to this embodiment, showing decorative panel members 106 and 108 hung on side wall portion 34''. Side wall 34'' includes aluminum wall panel members 50', 52' and 54', which may be the same as hereinbefore described relative to cab 52 in FIG. 1, except for a plurality of small keyhole-shaped openings for receiving the head of fasteners attached to the back side of decorative panel members 106 and 108. The number of decorative panel members per wall portion, and their width dimensions, are selected to conceal the joints formed between the adjacent wall panel members 50', 52' and 54'.

Each decorative panel member, such as decorative panel member 106 which is shown in elevation in FIG. 14, and in cross section in FIG. 15, is of lightweight construction. As best shown in FIG. 15, which is a cross-sectional view of decorative panel member 106 taken between and in the direction of arrows XV—XV in FIG. 14, decorative panel member 106 includes a flat aluminum sheet member 110, which may have the same thickness dimension as the aluminum wall panel member 50. Aluminum sheet member 110 has first and second flat, major, opposed surface 112 and 114, respectively, and a plurality of elongated nonmetallic members 116, 118, 120 and 122 are adhesively bonded to the first major flat surface 112. Aluminum sheet member 110 is in the configuration of an elongated rectangle, and the elongated non-metallic members are aligned with the elongated dimension of the sheet member 110. Lateral edges of members 116 and 122 are aligned with the lateral edges of sheet 110, and screws are disposed therein having head portions shaped to cooperate with the keyhole openings in the aluminum wall panel members, so that the panels may be easily hung on the wall portions, and just as easily removed by lifting the decorative panel and then moving it horizontally away from the associated wall portion. The elongated non-metallic members may be constructed of wood, such as plywood, suitably treated to have a fire-retardant characteristic. As illustrated in FIG. 14, additional short pieces of elongated non-metallic members may be disposed horizontally at selected locations, taking care not to block the paths for air in the cab to flow through the ventilating openings 68 and 70 shown in FIG. 3, which paths are formed between certain of the wall panel members, such as wall panel member 50, and the decorative panel members.

The second major surface 114 of aluminum sheet member 110 may have a thin decorative sheet 124 adhesively bonded thereto, such as with contact glue, to achieve the desired decorative effect. A sheet 126 of the same decorative material may be adhesively bonded to the two lateral edges of the decorative panel defined by the thin edge of the aluminum sheet member 110, and by an edge of an elongated non-metallic member, such as member 116 shown in FIG. 15.

Figure 16:
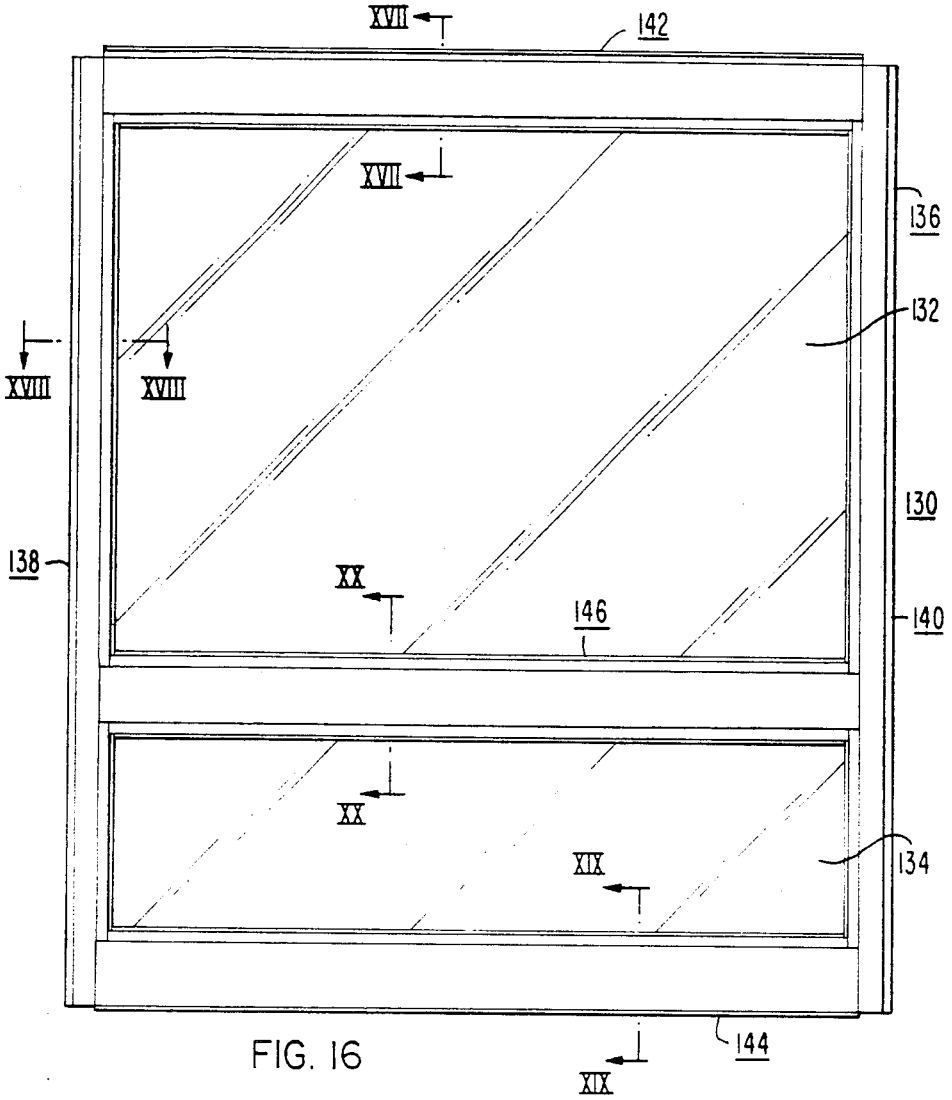
FIG. 16 is an elevational view of a rear wall portion of a cab in which the rear wall is constructed essentially of glass, instead of aluminum wall panel members.

In most instances, the rear wall portion 38 will be constructed of aluminum wall panel members, as shown in FIG. 1. However, the disclosed cab construction will readily accept a glass rear wall portion when required for an observation car. FIG. 16 is an elevational view of a rear wall portion 130 which may be substituted for the rear wall portion 38 shown in FIG. 1. In general, rear wall portion 130 includes upper and lower glass sheet members 132 and 134, respectively, the edges of which are supported by a resilient glazing structure mounted in a high-strength, glass support frame 136 which includes a plurality of metal channels. For example, stainless steel or bronze may be used to form the structural support elements of the channels.

More specifically, the metallic glass support frame 136 includes first and second upstanding metallic boxed columns 138 and 140, respectively, upper and lower horizontally oriented boxed channels 142 and 144, respectively, and an intermediate horizontally oriented boxed channel 146. The horizontally oriented channels 142, 144 and 146 are secured to the vertical columns 138 and 140.

Figure 17:
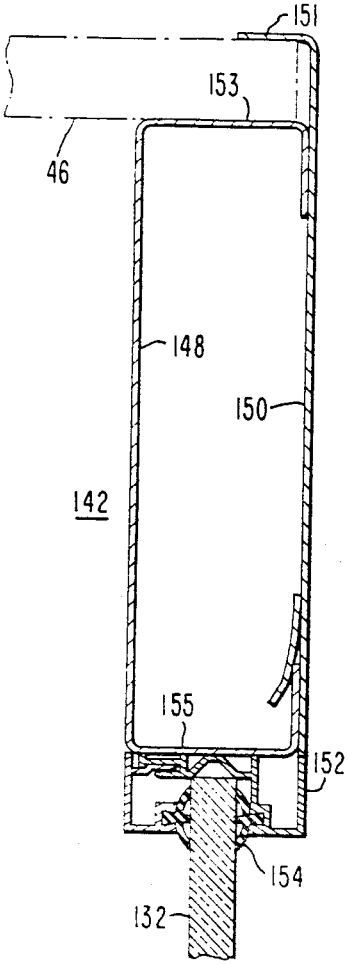
FIG. 17 is a cross-sectional view of the rear wall portion shown in FIG. 16, taken between and in the direction of arrows XVII—XVII.

FIG. 17 is a cross-sectional view of upper horizontal boxed channel 142, taken between and in the direction of arrows XVII—XVII in FIG. 16. A metallic channel member 148 is boxed by a metallic angle member 150, with an end 151 of angle member 150 extending past the end 153 of channel 148 to form a recess for receiving the canopy 46. A metallic channel structure 152 is secured to the lower end 155 of channel 148, which supports resilient glazing 154 for holding the upper edge of glass panel 132.

FIG. 18 is a cross-sectional view of column 138, taken between and in the direction of arrows XVIII—XVIII in FIG. 16. A metallic channel member 156 is boxed by a metallic angle member 158, with an end 159 of angle member 158 cooperating with a lateral flange of wall portion 36 to secure the column 138 to the side wall portion 36. A metallic channel structure 160 is secured to an upstanding edge of channel 156, which supports resilient glazing 162 for holding lateral edges of glass panels 132 and 134.

Figure 19:
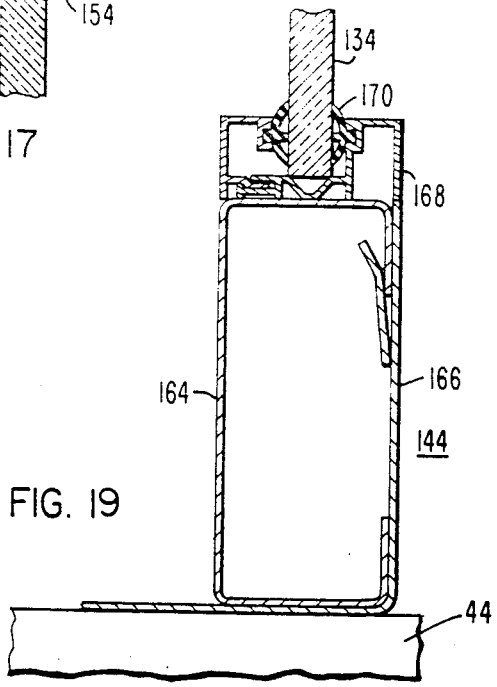
FIG. 19 is a cross-sectional view of rear wall portion shown in FIG. 16, taken between and in the direction of arrows XIX—XIX.

FIG. 19 is a cross-sectional view of lower horizontal boxed channel 144, taken between and in the direction of arrows XIX—XIX in FIG. 16. A metallic channel member 164 is boxed by a metallic angle member 166. A metallic channel structure 168 is secured to the upper edge of channel 144, which supports resilient glazing 170 for holding the lower edge of glass panel 134.

Figure 20:
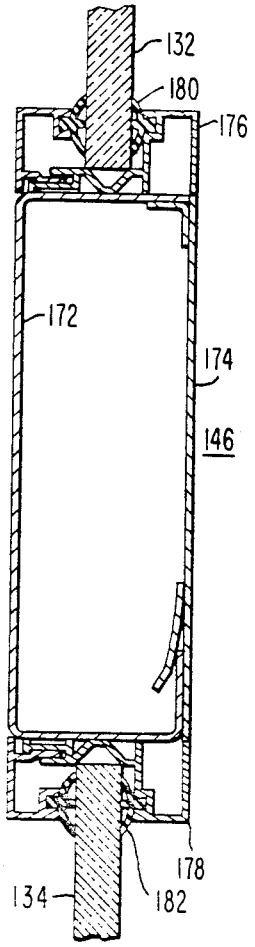
FIG. 20 is a cross-sectional view of rear wall portion shown in FIG. 16, taken between and in the direction of arrows XX—XX.

FIG. 20 is a cross-sectional view of the intermediate horizontal boxed channel 146, taken between and in the direction of arrows XX—XX in FIG. 16. A metallic channel member 172 is boxed by a metallic angle member 174. Metallic channel structures 176 and 178 are secured to the upper and lower edges of channel 172, which channel structures support resilient glazing 180 and 182, respectively, for holding edges of glass panels 132 and 134.

Figure 21:
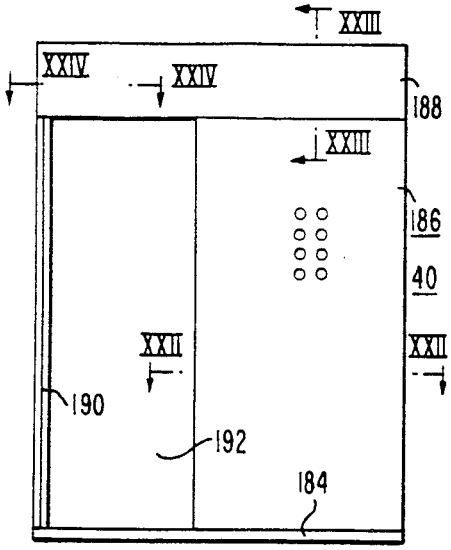
FIG. 21 is an elevational view of the upstanding front wall portion of the cab shown in FIG. 1.
Figure 23:
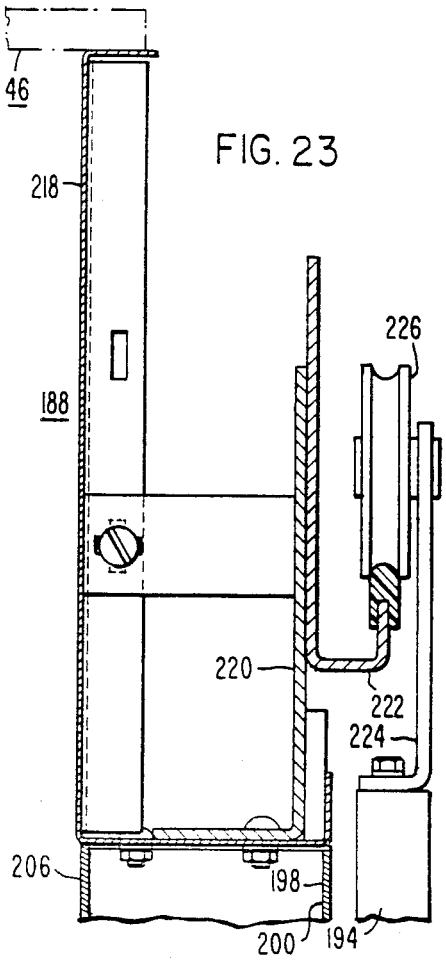
FIG. 23 is a cross-sectional view of the front wall portion shown in FIG. 21, taken between and in the direction of arrows XXIII—XXIII.
Figure 24:
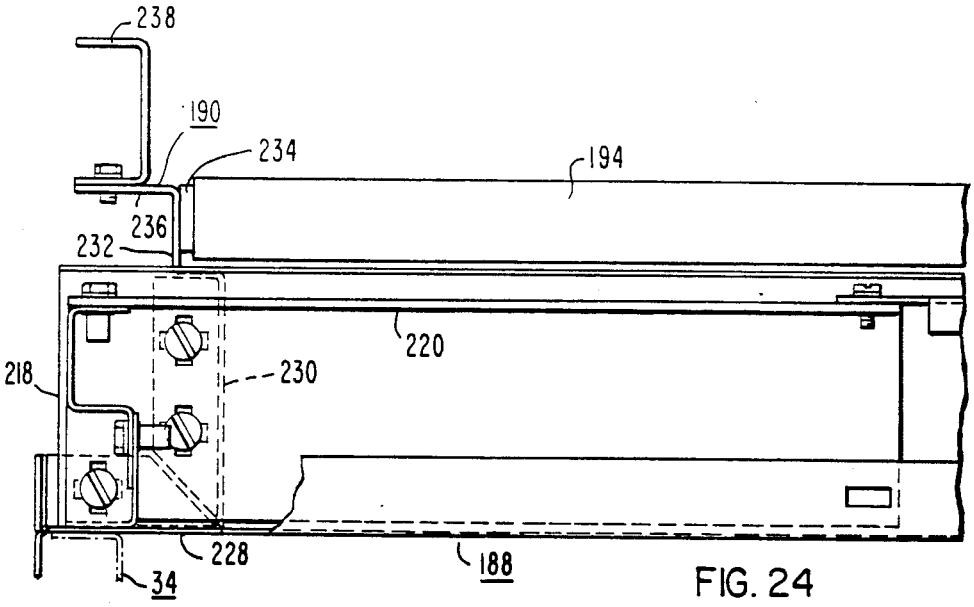
FIG. 24 is a cross-sectional view of the front wall portion shown in FIG. 21, taken between and in the direction of arrows XXIV—XXIV.

FIG. 21 is an elevational view of front portion 40 of the elevator cab 42 shown in FIG. 1. Front portion 40, which is shipped to the job site completely assembled and wired, on a shipping brace 184, includes a swing return portion 186, a transom 188, and a strike post 190. The swing return 186, transom 188, and strike post 190 define an opening 192 which a car door 194, shown in FIGS. 23 and 24, is mounted to open and close the entrance to the cab. With a center door opening, such as cabs 82 and 104 shown in FIGS. 9 and 13, respectively, a swing return portion is disposed on each side of the central door opening.

Figure 22:
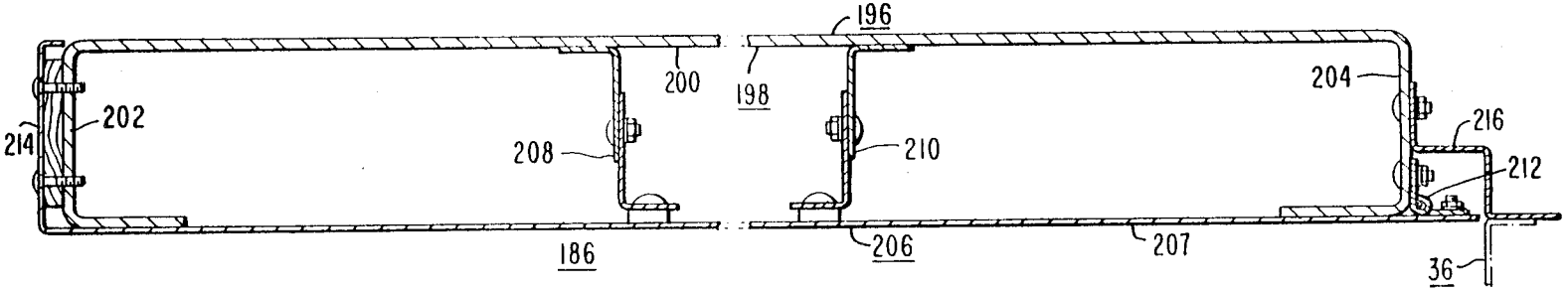
FIG. 22 is a cross-sectional view of the front wall portion shown in FIG. 21, taken between and in the direction of arrows XXII—XXII.

FIG. 22 is a cross-sectional view through the swing return portion 186. Swing return portion 186 includes a stationary return assembly 196, which includes a relatively thick aluminum channel member 198 selected to provide support for the canopy 46 and door operator 99 mounted on the canopy 46 adjacent to the front portion 40. Channel 198 includes a bight portion 200 and first and second leg portions 202 and 204. The extreme ends of leg portions 202 and 204 are bent into a common plane, which is spaced from and parallel to bight portion 200, to provide support for a pivotable swing panel portion 206. Intermediate support for swing panel portion 206 is provided by Z-shaped support brackets 208 and 210 which are fixed to bight 200.

Swing portion 206 includes a hinge assembly 212 which is fixed to channel leg 204. Swing portion 206 further includes a leg portion 214 which is fastened to channel leg 202 when the swing panel 206 is in its closed position. A bracket 216 is fastened to channel leg 204 for cooperating with a flange on the lateral edge of side wall portion 36, to secure front 40 to wall portion 36.

It will be noted that swing portion 206 includes a flat sheet 207 which faces the inside of cab 32, and it is pre-punched for mounting the various car fixtures, such as the car call pushbuttons, car position indicator, and the like. Thus, a separate fixture mounting panel is not required. The stationary and swing portions 196 and 206 cooperatively define a large wiring duct which extends across the complete front of the cab, eliminating the need for separate junction boxes for wiring the fixtures mounted in the swing panel 206.

FIG. 23 is a cross-section view through the transom 188, taken between and in the direction of arrows XXIII—XXIII in FIG. 21. Transom 188 includes an aluminum channel member 218 which faces the inside of the cab, and a stainless steel right angle member 220 which has one leg fastened to channel 218 and to the top of the stationary return 198, and an upstanding leg to which a door hanger track 222 is attached. Door 194 includes hanger plates 224 and hanger rollers 226, which cooperate with the door hanger track 222.

FIG. 24 is a cross-sectional view taken through the transom 188, between and in the direction of arrows XXIV—XXIV in FIG. 21. FIG. 24 clearly illustrates the strike post channel 190 which includes a plurality of leg portions, including a leg 228 to which the wall portion 34 is secured, a leg 230 which functions as the door jamb, and a leg 232 which includes a bumper 234 for cushioning the door as it reaches its closed position, and a leg 236 which may be connected to a channel 238. Channel 238 is used as a sight guard and to mount photo cell apparatus.

Figure 25:
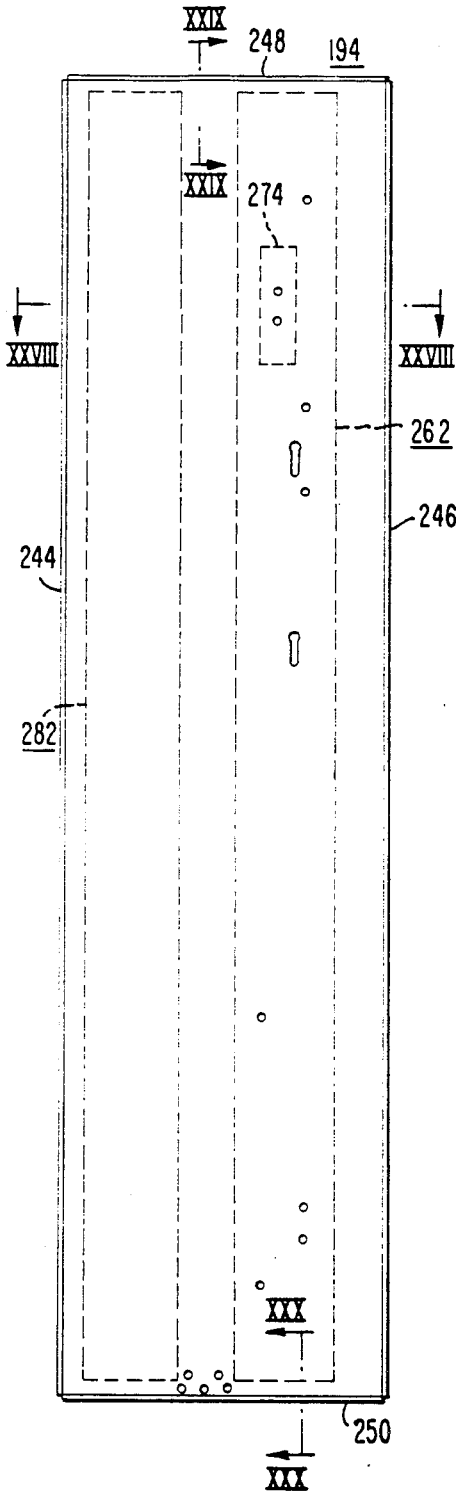
FIG. 25 is an elevational view of an aluminum door panel which may be used with the elevator cabs shown in FIGS. 1, 9 and 13, which panel is constructed according to the teachings of the invention.

FIG. 25 is an elevational view of a lightweight door panel 194, as viewed from the hallway side. One or more door panels are required per cab, depending upon whether the cab doors are side or center opening, and whether they are single or two speed. Door panel 194 includes a front pan 240 constructed of aluminum, shown in FIG. 26, and a rear pan 242 constructed of aluminum, shown in FIG. 27. Door panel 194 has upstanding lateral edges 244 and 246, an upper edge 248, and a lower edge 250.

Figure 28:
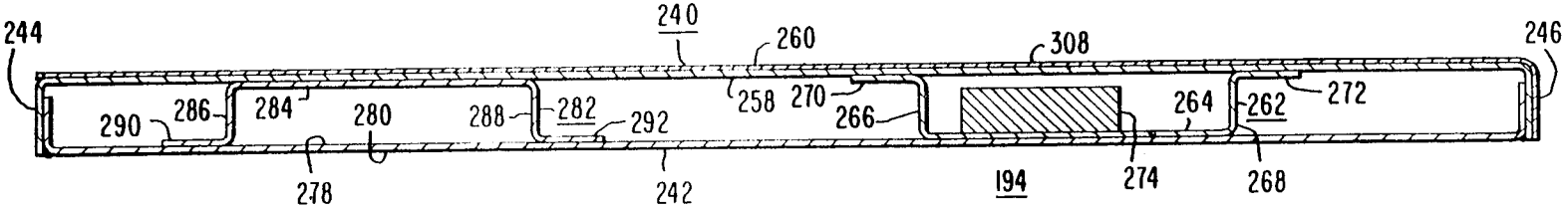
FIG. 28 is a cross-sectional view of the aluminum door panel shown in FIG. 25, taken between and in the direction of arrows XXVIII—XXVIII.

FIG. 28 is a cross-sectional view of door panel 194 taken between the lateral edges 244 and 246, in the direction of arrows XVIII—XVIII in FIG. 25. FIG. 28 illustrates the construction and assembly of the front and rear pans 240 and 242.

Figure 29:
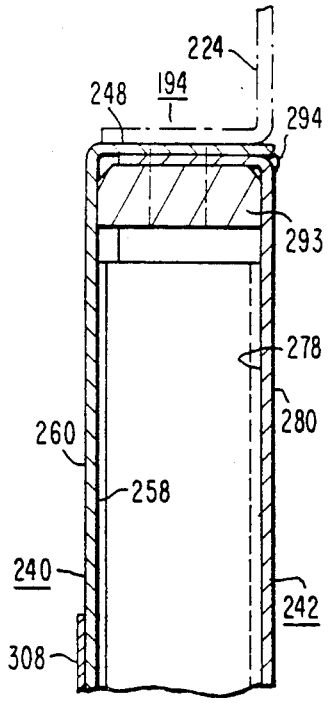
FIG. 29 is a cross-sectional view of the aluminum door panel shown in FIG. 25, taken between and in the direction of arrows XXIX—XXIX.

FIG. 29 is a cross-sectional view of door panel 194 taken between and in the direction of arrows XXIX—XXIX in FIG. 25, illustrating the upper edge 248 of the door panel 194.

Figure 30:
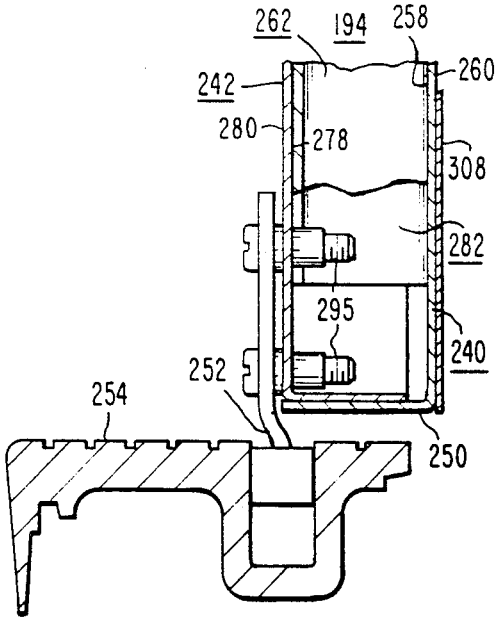
FIG. 30 is a cross-sectional view of the aluminum door panel shown in FIG. 25, taken between and in the direction of arrows XXX—XXX.

FIG. 30 is a cross-sectional view of door panel 194 taken between and in the direction of arrows XXX—XXX in FIG. 25, illustrating the lower edge 250 of door panel 194, a door gib 252, and a door sill 254.

Figure 26:
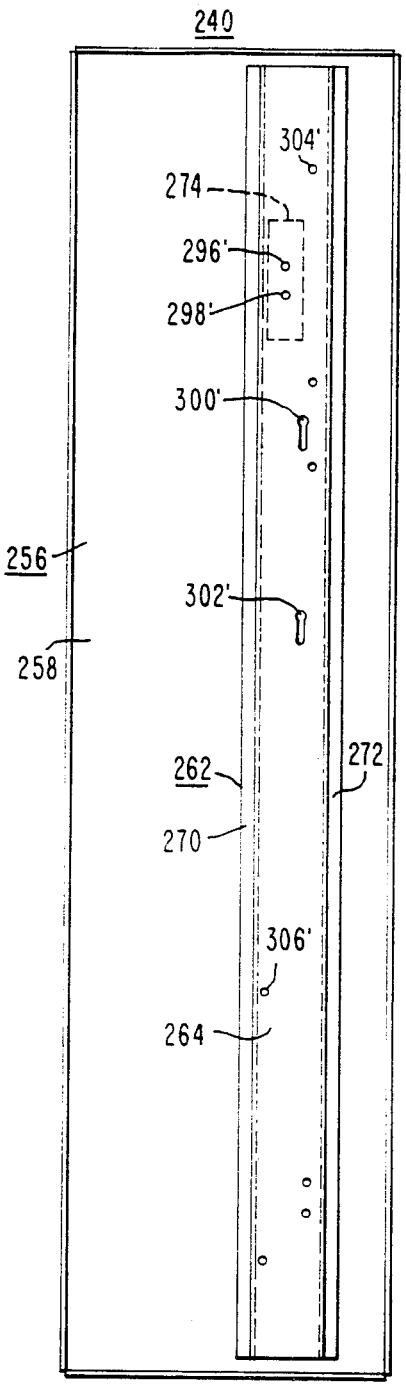
FIG. 26 is an elevational view of a front pan section, which is used to construct the aluminum door panel shown in FIG. 25.

More specifically, FIG. 26 is a view of the internal side of the front pan 240, i.e., the side which is oriented towards the hallway. It includes a flat aluminum sheet member 256 having an elongated rectangular configuration. Sheet member 256, which may be 0.063 inch thick, has inner and outer flat major surfaces 258 and 260, respectively, with the outer surface 260 being the outer surface of the door panel which faces the interior of the elevator cab. Sheet member 256 is perimetrically flanged on all edges, with the flanges extending perpendicularly outwardly from inner surface 258.

An elongated reinforcing rib member 262 constructed of aluminum has a channel-shaped cross-sectional configuration, including a bight 264 and leg portions 266 and 268. The ends of the leg portions 266 and 268 are flanged, creating flanges 270 and 272, respectively, which are bent outwardly to lie in a common plane. A metallic block 274 of aluminum is welded to bight 264, between the spaced legs 266 and 276, to provide an anchor point for the power arm 101 of the door operator 99. Flanges 270 and 272 of the reinforcing rib member 262 are welded to the interior or inner surface 258 of sheet member 256. Rib 262 is located off center, towards one lateral edge, such as lateral edge 246 of the door panel 194.

Figure 27:
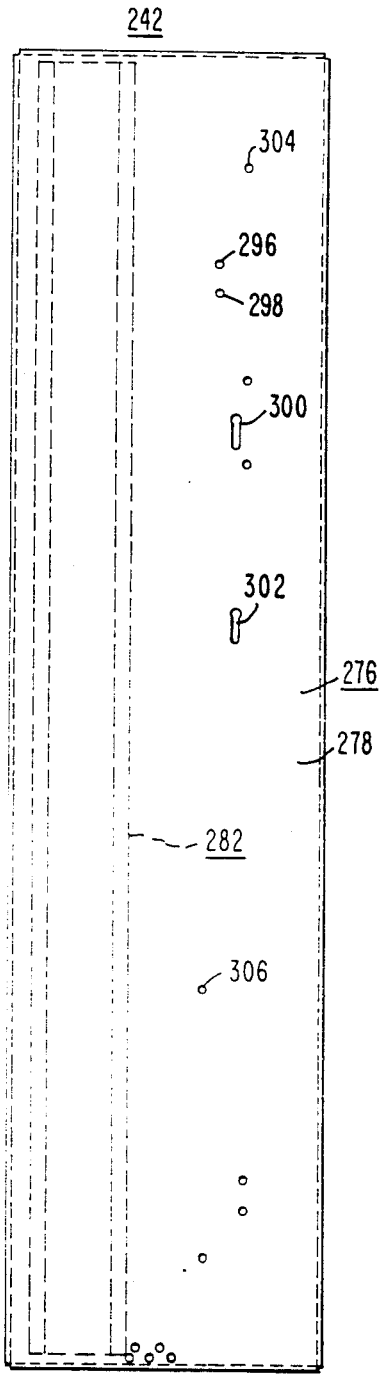
FIG. 27 is an elevational view of a rear pan section, used to construct the aluminum door panel shown in FIG. 25.

The rear pan 246 shown in FIG. 27 is similar in construction to the front pan 240. FIG. 27 is a view of the external side of the rear pan 242, i.e., the side which faces the hallway. It includes a flat aluminum sheet member 276 having an elongated rectangular configuration. Sheet member 276, which may be 0.063 inch thick, has inner and outer flat major surfaces 278 and 280, respectively, with the outer surface 280 being the outer surface of the door panel which faces the hallway. Sheet member 276 is perimetrically flanged on all edges, with the flanges extending perpendicularly outward from inner surface 278.

An elongated reinforcing rib member 282 constructed of aluminum has a channel-shaped cross-sectional configuration, including a bight 284 and leg portions 286 and 288. The ends of the leg portions 286 and 288 are flanged, having flanges 290 and 292, respectively, which flanges lie in the common plane. The flanges 290 and 292 of the reinforcing rib member 282 are welded to the inner surface 278 of sheet member 276. Rib 282 is located off center, towards one lateral edge, such as lateral edge 244 of door panel 194. A steel tap bar 293 is secured against the inside of the flange of the rear pan 242, which flange will appear at the upper edge 248 of the door panel. Hangers 224 are bolted to the tap bar 293. A plurality of nut inserts 295 are fixed to the inner surface 278 of the rear pan 242, near the bottom flanged edge, for attaching door gibs 252.

The rear door pan member 242 is sized such that its flanged edges will snugly enter the blind opening defined by the flanged edges of the front door pan member 240, i.e., the rear pan 242 is telescoped snugly into the front pan 240. The external surfaces of the bight portions of the reinforcing ribs 262 and 282 are coated with an adhesive so that they bond to the inner surface of the opposing pan member. The two pans are tack welded at spaced locations about the door panel, such as indicated at 294 in FIG. 29.

It is important to note that all openings for mounting external hardware to the door panel proceed through the rear pan 242, and also through the reinforcing rib 262 of the front pan 240, bonding the two pans firmly together for increased strength and rigidity. For example, openings 296 and 298 through the rear pan are aligned with openings 296' and 298' of the rib 262, so that the door operator driving arm 101 can be attached to block 274. Openings 300 and 302 in the rear pan 242 are aligned with openings 300' and 302', respectively, in rib 262, for mounting the drive vane. Opening 304 in the rear pan 242 is aligned with opening 304' in rib 262 for mounting the door safety edge. Opening 306 in the rear pan 242 is aligned with opening 306' in rib 262, for mounting the photocell system.

As shown in FIGS. 28, 29 and 30, the surface 260 of door panel 194 which is exposed to view from within the cab, may have a thin sheet 308 of decorative cladding, such as a sheet 0.030 inch thick, with the cladding being stainless steel, bronze, or the like. The cladding is adhesively bonded to the door panel.

The disclosed door panel construction reduces the weight of the car doors by about 50%, compared with prior art construction, without compromising the strength and rigidity of the door panel. The lighter door panel applies less load to the door operator, which will extend its life, and the lighter door panels contribute to the overall reduction in weight of the elevator cab, which thus contributes to providing all of the advantages of a lightweight cab, hereinbefore set forth.

We claim as our invention:

1. A lightweight elevator cab, comprising:

upstanding side, rear and front wall portions assembled to define an enclosure having inner and outer surfaces and upper and lower edges, said upstanding front wall portion including a swing return portion, said swing return portion including a stationary return assembly comprising an aluminum channel member, and a pivotable swing panel punched for fixtures, said swing panel having a closed position which cooperates with said channel member to define a wiring duct, a transom disposed above the swing return, said transom including an L-shaped metallic member mounted on the aluminum channel member of the stationary return assembly, with said L-shaped metallic member being adapted to provide support for a door operator, at least said side wall portions being formed of aluminum wall panel members having flat major surfaces, each of said aluminum wall panel members having flanged lateral edges and flanged upper and lower edges, with the flanged lower edge being adapted to be secured to a platform, means joining the flanged lateral edges of adjacent wall panel members together, and a canopy attached to the upper edges of the enclosure, said canopy comprising aluminum honeycomb having a plurality of cells, the terminating edges of which lie in first and second flat, parallel planes, and flat aluminum sheet members adhesively bonded to terminating edges of said honeycomb cells, to form flat upper and lower surfaces of the canopy.

2. The lightweight elevator cab of claim 1, wherein the upper surface of the canopy is adapted to mount a ventilating fan, and including vertically aligned upper and lower openings in the flat aluminum sheet members which define the upper and lower surfaces of the canopy, with said openings exposing the aluminum honeycomb, said exposed aluminum honeycomb functioning as a grille for the ventilating fan.

3. The lightweight elevator cab of claim 1, wherein each wall portion formed of aluminum wall panel members includes a plurality of horizontally adjacent aluminum wall panel members having a height dimension selected according to a predetermined minimum cab height dimension, and including a single additional elongated aluminum wall panel member having first and second flanged lateral edges, said additional wall panel member being disposed to extend across all of the horizontally adjacent aluminum wall panel members of the wall portion, and including means fixing the flanged upper edges of the horizontally adjacent aluminum wall panel members to the first flanged lateral edge of the additional wall panel member, with the second flanged lateral edge of the additional wall panel member being secured to the canopy, said additional wall panel member having a dimension between its first and second flanged lateral edges selected to provide the desired cab height.

4. A lightweight elevator cab, comprising:

upstanding side, rear and front wall portions assembled to define an enclosure having inner and outer surfaces and upper and lower edges, said upstanding front wall portion including a door assembly having at least one door panel having lateral, top and bottom edges, said at least one door panel comprising front and back aluminum pan members, each of said front and back aluminum pan members having flat, rectangularly shaped portions defining inner and outer major flat surfaces perimetrically flanged portions which extend perpendicularly outward from the inner surface, and an elongated aluminum stiffening rib fixed to the inner surface which includes a flat portion having inner and outer surfaces spaced from and parallel to the inner major flat surface, said rear pan member being telescoped snugly into said front pan member, with their adjacent perimetrically flanged edges in contact, and with the outer surface of the flat portion of each rib in contact with the inner major flat surface of the opposing pan member, and tack welds disposed to hold the front and rear panel members in assembled relation, at least said side wall portions being formed of aluminum wall panel members having flat major surfaces, each of said aluminum wall panel members having flanged lateral edges and flanged upper and lower edges, with the flanged lower edge being adapted to be secured to a platform, means joining the flanged lateral edges of adjacent wall panel members together, and a canopy attached to the upper edges of the enclosure, said canopy comprising aluminum honeycomb having a plurality of cells, the terminating edges of which lie in first and second flat, parallel planes, and flat aluminum sheet members adhesively bonded to terminating edges of said honeycomb cells to form flat upper and lower surfaces of the canopy.

5. The lightweight elevator cab of claim 4 including a tap-block adapted for connection to a door operator drive arm, said tap-block being fixed to the inner surface of the flat portion of the elongated aluminum rib of the front aluminum pan member, said tap-block having tapped openings accessible through aligned openings in the back portion of its associated rib and in the flat rectangularly shaped portion of the back aluminum pan member, such that both pans are drawn tightly together when the drive arm of a door operator is attached to the top block.

6. The lightweight elevator cab of claim 4 including an adhesive disposed between the outer surfaces of the flat portions of the aluminum stiffening ribs and the contacting inner surface of the opposing pan member.

7. The lightweight elevator cab of claim 4 including metallic tap bar adapted for connection to a door hanger plate, said metallic tap bar being disposed below the contacting flange portions which define the top edge of the door panel.

8. The lightweight elevator cab of claim 4 including openings in the back aluminum pan member adjacent to the bottom edge of the door panel, and threaded inserts fixed to the inner surface of the back pan member aligned with said openings, for attaching door gibs.

* * * * *